US012426649B1

(12) United States Patent
Mencia

(10) Patent No.: US 12,426,649 B1
(45) Date of Patent: Sep. 30, 2025

(54) OPEN SEAT LEGGINGS WITH CURTAIN

(71) Applicant: Lorena Eguigure Mencia, Dillon, CO (US)

(72) Inventor: Lorena Eguigure Mencia, Dillon, CO (US)

( * ) Notice: Subject to any disclaimer, the term of this patent is extended or adjusted under 35 U.S.C. 154(b) by 0 days.

(21) Appl. No.: 18/604,032

(22) Filed: Mar. 13, 2024

(51) Int. Cl.
*A41D 1/06* (2006.01)
*A41B 9/00* (2006.01)

(52) U.S. Cl.
CPC ..... *A41D 1/065* (2013.01); *A41B 9/005* (2013.01); *A41D 2300/50* (2013.01); *A41D 2400/38* (2013.01)

(58) Field of Classification Search
CPC ..... A41B 9/005; A41B 11/14; A41B 9/026; A41B 9/04; A41B 9/10; A41B 9/004; A41B 9/08; A41B 11/01; A41B 9/007; A41D 1/065; A41D 2300/50; A41D 2400/38
USPC ..... 2/78.2, 405, 408, 409
See application file for complete search history.

(56) References Cited

U.S. PATENT DOCUMENTS 744,885 A * 11/1903 Velasko ..... A41B 9/08 2/78.2
969,808 A * 9/1910 Saldin ..... A41B 9/08 2/78.2
1,084,418 A * 1/1914 Farquhar ..... A41B 9/08 2/78.2
1,469,287 A * 10/1923 Torchia ..... A41B 9/04 2/408
1,512,171 A * 10/1924 Homling ..... A41B 9/08 2/78.2
1,546,518 A * 7/1925 Swantees ..... A41B 9/08 2/78.2
2,239,972 A * 4/1941 Rauser ..... A41B 9/02 2/403

(Continued)

FOREIGN PATENT DOCUMENTS

CN 111743223 A 10/2020
CN 214547305 U 11/2021

(Continued)

OTHER PUBLICATIONS

English translation of KR 100987199 (doc pub Oct. 2010). (Year: 2010).*

*Primary Examiner* — Amy Vanatta
(74) *Attorney, Agent, or Firm* — Williams Intellectual Property

(57) ABSTRACT

An open seat leggings with curtain is fastenerless clothing that covers at least a portion of the lower, and in some embodiments upper, body of the wearer and possesses a flexible seamed opening in the crotch portion that is concealed by a curtain portion. The open seat leggings possess no in-seam, may vary in length, and may further include crus portions having specifically performing seams or stich lines. The curtain portion may comprise a separate removable article of clothing that overlies the open seat leggings or a permanently affixed portion wherein its top edge is stitched into the waistband of the open seat leggings. In every embodiment, wearers may draw the curtain portion aside then squat or sit to widen the seamed opening while maintaining the curtain's orientation hands-free throughout use. Further embodiments contemplate the addition of bra, tank-top, collar, sleeve, forearm, hand loop, and foot loop portions.

17 Claims, 6 Drawing Sheets

(56) References Cited

U.S. PATENT DOCUMENTS

| | | | | |
|---|---|---|---|---|
| 2,812,516 | A | 11/1957 | Hoffman | |
| 3,020,556 | A * | 2/1962 | Isley | A41B 11/14 2/409 |
| 3,398,739 | A | 8/1968 | Marino | |
| 3,844,282 | A * | 10/1974 | King | A41B 9/023 2/405 |
| 4,807,304 | A * | 2/1989 | McCants-Reed | A41B 9/02 2/405 |
| 5,060,315 | A * | 10/1991 | Ewing | A41B 9/005 2/400 |
| 6,192,522 | B1 | 2/2001 | Schreib | |
| 6,928,661 | B2 | 8/2005 | Lewis et al. | |
| 6,941,584 | B1 | 9/2005 | Matthews | |
| 7,100,214 | B1 | 9/2006 | Murray | |
| 8,479,320 | B2 | 7/2013 | Swafford | |
| 9,089,173 | B2 | 7/2015 | Krishnan | |
| 10,555,564 | B2 | 2/2020 | Brady et al. | |
| 11,357,265 | B2 * | 6/2022 | Hanson Allen | A41B 9/007 |
| 2001/0014981 | A1 * | 8/2001 | Fairhurst | A41D 13/02 2/456 |
| 2006/0277649 | A1 * | 12/2006 | Smith | A41D 1/088 2/69 |
| 2008/0222770 | A1 | 9/2008 | Oates | |
| 2010/0269243 | A1 | 10/2010 | Paree | |
| 2012/0222187 | A1 * | 9/2012 | McLaren | A41D 13/0015 2/69 |
| 2014/0182048 | A1 | 7/2014 | Gregory | |
| 2014/0273735 | A1 | 9/2014 | Cohen Larren et al. | |
| 2015/0157058 | A1 | 6/2015 | Mccombs | |
| 2016/0219945 | A1 | 8/2016 | Chen | |
| 2017/0006925 | A1 | 1/2017 | Priest | |
| 2017/0119066 | A1 | 5/2017 | Robinson | |
| 2021/0037896 | A1 | 2/2021 | Mercer | |
| 2021/0052021 | A1 | 2/2021 | Davis | |
| 2021/0106078 | A1 | 4/2021 | Kraft | |

FOREIGN PATENT DOCUMENTS

| | | | |
|---|---|---|---|
| GB | 228078 | A * | 1/1925 |
| JP | 323716 | U | 4/2022 |
| KR | 100987199 | B1 * | 10/2010 |
| WO | 2015024969 | A1 | 2/2015 |
| WO | 2015103705 | A1 | 7/2015 |
| WO | 2020122929 | A1 | 6/2020 |

* cited by examiner

OPEN SEAT LEGGINGS WITH CURTAIN

BACKGROUND

Various types of pants, shorts, panties, jumpsuits, and other articles of clothing having some sort opening, gap, or mechanism for accessing the crotch of a wearer without having to completely disrobe exist in the prior art, specifically for use by females in relation to urination, intercourse, and sanitation. While men's clothing offers a "fly" for quick release and minimal disrobing as it relates to urination and intercourse, there is no equivalently effective offering for women's clothing, which means that no matter the occasion, location, or preference of females, they must disrobe (almost entirely in some cases) in order to relieve themselves, replace a sanitary pad or tampon, or to have sexual intercourse.

A few of the more common methods and means of securing the crotch opening, gap, or hole in the articles of clothing seen in the disclosed references include fasteners such as buttons, zippers, hooks, clasps, and hook-and-loop portions.

U.S. Pat. No. 9,089,173, issued to Krishnan, discloses a garment having a flap on the front of the bifurcated legged clothing that extends beyond the crotch area and utilizes zippers, buttons, clasp lockers, or alternative fasteners to secure the flap in place when not in use as well as securing the flap in place elsewhere on the garment while in use.

U.S. Pat. No. 8,479,320, issued to Swafford, discloses an article of clothing having a flap on the rear, or across the loin and buttocks regions, that may open to expose the backside of the pelvic region of a wearer, wherein the flap is capable of extending around the wearer to varying degrees and fastening (or attaching via fasteners) to another portion of the garment, thereby keeping the flap from getting soiled.

U.S. Pat. No. 7,100,214, issued to Murray, relates to articles of women's clothing having openable crotch positions that are specifically and intentionally lacking zippers and straight seams due to the tendency of such stiff seams to bunch, pucker, and thereby chafe the wearer, as opposed to two overlapping flaps with the option of including snaps, or other less cumbersome fastening devices, on each flap.

U.S. Pat. No. 10,555,564, issued to Brady et al., pertains particularly to women's pants that allow a wearer to engage in sexual intercourse or undergo gynecological exams without undressing, wherein all that is required is for the wearer (or their partner) to manually pull back, or aside, the multiple overlapping and biased free edges of the crotch portion's covers then use the inserted member or gynecological device to force the material to remain in the open position. While this document doesn't call for, or specifically include, any fasteners or fastening systems in its design, there is an acknowledgement that other embodiments may see the addition thereof. The overall design herein is somewhat similar to U.S. Pat. No. 3,398,739, issued to Marino, wherein the invention relating to women's undergarments includes a specially constructed crotch design that requires the wearer to draw back the overlapping and biased free edges of multiple flaps covering the crotch with their fingers and continue to hold them apart (as opposed to a tool or partner's member accomplishing the same in the Brady patent). Neither patent discusses invented matter nor contemplates an embodiment of their invention that can maintain an opening without physical intervention by the wearer, another person, or a tool wielded thereby.

Several other disclosed references include slightly altered designs for front or rear flaps, inner thigh zippers that either follow the inner seam of the clothing or extend from the front waistband to the rear waistband, invisible or hidden zipper designs, overlapping flaps that require maintained manual or digital separation of multiple flaps (or covers) for use, as well as multiple other approaches that require the use of buttons, hooks, hook-and-loop, snaps, clasps and other fastening devices.

As has been pointed out within many of the disclosed reference documents, and touched on above, there exists a divide between articles of clothing for men and those for women when it comes to the comfortability, ease of direct access to, and proportionality of design elements relating to the genital region, specifically resulting in women's garments that may utilize more comfortable material, but which lack direct and easy access to genitals for purposes of urination, sanitation, medical checkups, or sexual intercourse. The majority of disclosed reference documents, and designs therein, seek to remedy the lack of this access through the addition of fastened flaps, zippered regions, Velcro-ed regions, buttoned or hooked regions, as well as through regions having multiple overlapped free edge flaps that require continuous manual separation by a wearer's fingers or some member/tool for proper usage.

In addition to the central problem identified in most, if not all, of the disclosed reference documents directed towards women's garments having an openable crotch portion, the inclusion of the variety of fastening devices, apparatuses, and systems tend to create additional potential issues of irritation with a wearer's skin, bulkiness of the garment, breaking of the fastener thereby causing exposure and requiring mending or an additional purchase, as well as a higher likelihood of frictional wear and tear of the clothing. For the few disclosed reference documents that rely on overlapping flaps biased to the closed position, the biggest issue with such a design is the absolute necessity of wearers, or their partners and doctors, to manually open the crotch portion and keep it held (or propped) open during urination, replacement of sanitary items, medical examinations, or sexual intercourse. If both hands are required to manually open, and/or hold open, the overlapping edges, then it will be difficult for the wearer to use one of their hands for the aforementioned actions/activities and the likelihood of the wearer soiling the garment or their hands, due to the close proximity and difficult angle of access and view, will be quite high.

What is needed in the art is an article of clothing for women that includes an opening in the crotch region, not utilizing any sizable, bulky, or irritating fasteners, that is easily openable without a wearer needing to manually unlock, unclasp, unbutton, unzip, or continuously hold open any flap or covering. This openable region also needs to be designed such that there is little to no chance of accidental or incidental public exposure during strenuous exercise, stretching, sporting, or other potential activities of the wearer. Additionally, any other design elements within this article of clothing should increase the usability and comfortability felt by the wearer.

FIELD OF THE INVENTION

The present invention relates to a form fitting garment having a flexible opening about the crotch, and more particularly, to such a garment that will be particularly utilized by women who are exercising, playing a sport, being active, or who are otherwise in public, the outdoors, or some place where it is inconvenient, distressing, or embarrassing to disrobe in order to use the bathroom, replace a sanitary item in, or otherwise access, their vaginal region.

SUMMARY

The general purpose of the open seat leggings with curtain, described subsequently in greater detail, is to provide a tight-fitting, or compressed, article of clothing which has many novel features that result in a garment possessing a flexible crotch opening which is not anticipated, rendered obvious, suggested, or even implied by prior art, either alone or in combination thereof.

According to one embodiment of the present invention, an article of clothing that covers at least a portion of the lower body of the wearer and possesses a flexible openable crotch portion without the utilization of any fastening means, devices, or systems is provided. This crotch portion includes a seamed gap opening and a curtain portion disposed to cover and protect said opening. In one contemplated embodiment, the crotch portion's opening resembles a slit when in the closed position and an ovoid or elliptical shape when in the open position. The perimeter of the openable crotch portion is comprised of at least two seams, or stitches, within the underlying material while the curtain portion is partially affixed, via its upper edges, to the other parts of the article of clothing such that the side edges overlay the underlying material while being freely movable by the wearer prior to and after use. This seamed gap opening, unlike prior art references cited above, lacks any inseams that are otherwise shown to be located along a wearer's inner thigh and meeting at the crotch region. During usage of this embodiment of the present invention, a wearer will only need one hand to move aside the curtain portion, thereby revealing the seamed gap opening about the crotch within the underlying material and, upon squatting, sitting, crouching or spreading of the wearer's legs, the curtain portion will remain drawn aside due to the material tension while the seamed gap will open to allow the wearer to relieve themselves, replace a sanitary device, engage in sexual intercourse, etc. Once a wearer has finished their business, simply standing up will return the seamed gap portion from an open position to a closed one while simultaneously releasing the tension in the curtain portion to allow the wearer to easily slide it back over the seamed gap portion such that the free edges may nest on either side of the vaginal area.

Unlike previous designs in the disclosed references, wherein two covers or free-edged flaps are included either with, or without, fastening devices, this embodiment of the present invention simply has a singular curtain, or cover. Additionally, where those previous designs include overlapping and biased flaps, covers, or free edges in their embodiments along with inseams disposed therefrom, the present invention's seamed perimeter has no such overlapping bias or inseams such that when in its closed position the seamed gap portion's sides will meet centrally and not be pushed into overlaying atop one another. Similarly, unlike previous designs wherein the wearer must physically open the crotch region with their fingers and continuously hold it open with those same fingers or some other tool or member throughout use, at least one embodiment of the present invention contemplates a wearer pulling aside the singular curtain portion, to reveal the seamed gap portion of the underlying material, and after placing the pulled aside curtain portion into the channel about where the thigh meets the crotch region and squatting/sitting down, the material tension from that action will keep the curtain portion within the channel and away from the now open seamed gap portion. This is achieved, in at least one contemplated embodiment, by manufacturing the curtain portion to be proportionately shorter in crotch (or seat) depth dimensionality to create added tension, thereby keeping it tauter or tighter and guaranteeing that it remain in whatever placement the wearer chooses. Such an embodiment allows a wearer to utilize their hands for other tasks during use of the present invention, while assuring minimal soiling of their hands and the portions of the garment about the seamed opening.

Additional embodiments of the present invention may include the curtain portion's upper edges affixed to only part of a waistband, which may be of varying thickness or height, affixed to the entirety of the waistband about the whole waist and/or wrapping each leg of the wearer, or affixed to a different portion of the garment entirely. Other embodiments contemplate designs of the present invention wherein the curtain portion is securably removable from the underlying garment, as a separate element of the present invention, thereby making cleaning of each portion of the open seat leggings with curtain easier while also allowing for interchangeability of each element for mixing and matching of colors, patterns, or designs thereof.

Further contemplated embodiments expanding upon the open seat leggings with curtain may include a torso and bra element forming a leotard-esque component wherein the curtain portion is the bottom portion thereof. The open seat leggings with curtain is envisioned in at least one embodiment contemplated herein as possessing a control cut line where the curtain portion is attached around the lower bodice, such that the cut line may be part of the waistline and/or part of the leg cut lines. Unfortunately, similar to bathing suits and leotards, the design of the curtain portion risks giving wearer's who stand up too quickly, without properly resituating the curtain portion, some discomfort. In addition to the contemplated embodiments of the present invention possessing waistbands of varying thickness or heights and/or a bra portion, further contemplated embodiments appreciate the inclusion of heel (or foot) loops, upper body portions having sleeves of varying lengths (with some possibly possessing hand loops at their distal ends), side pockets, as well as functional and/or decorative seams throughout that may be capable of increasing blood flow and circulation in the arms or legs (or portions thereof), as discussed below.

These open seat leggings with curtain are articles of clothing designed to be worn by women who partake in athletic, outdoor, sporting, festive, and other similar activities or undertakings but who are loath to undress mostly, or entirely, in order to use the restrooms at public, outdoor, or other locations where many of these activities and events tend to occur. Additionally, the open seat leggings with curtain would be excellent for traveling situations where restrooms may lack adequate space for a wearer to fully undress comfortably, while the facilities themselves may not be especially clean, as well as for exercising and swimming situations wherein the wearer is wet and disrobing completely only to redress in those same wet clothes would be cumbersome. Likewise, wearers of the present invention may simply choose to use the present invention at home as loungewear, especially in colder climates, either with or without the curtain component. Examples of articles of clothing that the present invention may be incorporated in include, but should not be limited to, tight-fitting (or compression) garments such as pants, leggings, jeggings, shorts, tights, body suits, leotards, bathing suits, girdles, jumpsuits, and various combinations or equivalents thereof.

In most of the contemplated embodiments discussed above, no part of the present invention includes any fasteners or any fastening devices, apparatuses, or systems that may resemble zippers, snaps, hooks, clasps, hook-and-loop, buttons, or relate thereto. However, that is not to say that future embodiments contemplated herein will not include at least one such device. For instance, an example future embodiment of the present invention is contemplated as including complementary magnetic components affixed within the waistband (or region thereof) of both the legging and curtain portion components such that usage of the invention will remain optimal where normal use over time otherwise causes wear and tear, or elastic relaxation, of the curtain component.

The open seat leggings with curtain may also be designated as a potentially therapeutic compression device due to the identifiable structural design elements, which are specifically included to increase blood flow and circulation throughout the wearer's limbs and encourage an active lifestyle. One such identifiable structural element of this, and other, embodiments of the present invention is the at least one crus portion wherein cut, seam, or stitch lines below the knee that run both horizontally and vertically down to the ankle hem are designed to create space for the knee to fold by removing pressure against the patella while simultaneously creating pressure along the cut, seam, or stitch lines to increase blood flow throughout the wearer's lower limbs. While these cuts, seams, or stitches may include portions of the seams of the open seat leggings with curtain, the presently illustrated embodiment includes cut lines below the knee following the grain line while the hem follows the cross line to create the tightest natural tension via the direction of the fabric's weave, such that the intake envisions the drafting of the center grain line as perpendicular to the hem. Additionally contemplated embodiments of the present invention may include further structural design elements, such as specifically located cut, seam, and stitch lines that assist the wearer in a comparable manner, whether it is by improving venous return and oxygenation while lowering muscular soreness, improving blood circulation/flow through muscles during active or resting use, or providing additional support to muscles, ligaments, or joints. One such manner of achieving this objective, as depicted in the illustrated embodiment, is by placing the center grain line adjacent to the cross line.

Although leggings are typically defined as pants, the present invention defines and considers the scope of the term to include shorts of varying lengths as well as pants of varying lengths, as well as all manner of lower body garments therebetween. In all embodiments of the present invention, the article of clothing is made of a combination comprising some, if not all, of the materials including Spandex, Lycra, nylon, silicon, cotton, elastane, polyester, or other elasticized polyurethanes, fibers, or blends thereof such that the open seat leggings with curtain may tautly conform to the wearer's body without excising undue or uncomfortable pressure thereon. Some embodiments contemplated herein may involve each portion of the present invention being made of only one such material, while additionally contemplated embodiments may envision each portion of the present invention being made of a combination of multiple materials in varying degrees. Thus has been broadly outlined the more important features of the present open seat leggings with curtain so that the detailed description thereof that follows may be better understood and in order that the present contribution to the art may be better appreciated. For better understanding of the open seat leggings with curtain, its operating advantages and specific objects attained by its uses, refer to the accompanying drawings and description.

BRIEF DESCRIPTION OF THE DRAWINGS FIGURES

Figure 1:
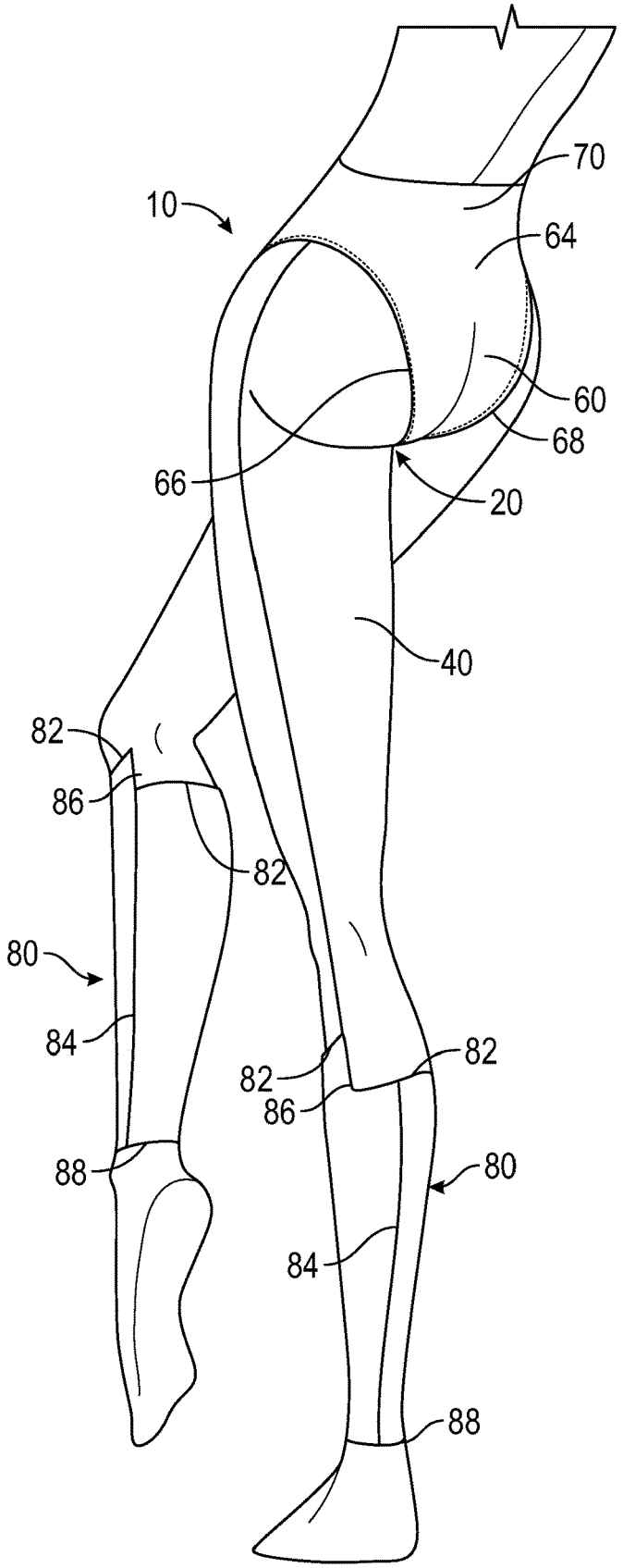
FIG. 1 is a rear isometric three-quarter turn view, with bent leg raised, of one example embodiment of the open seat leggings with curtain.
Figures 3A, 3B:
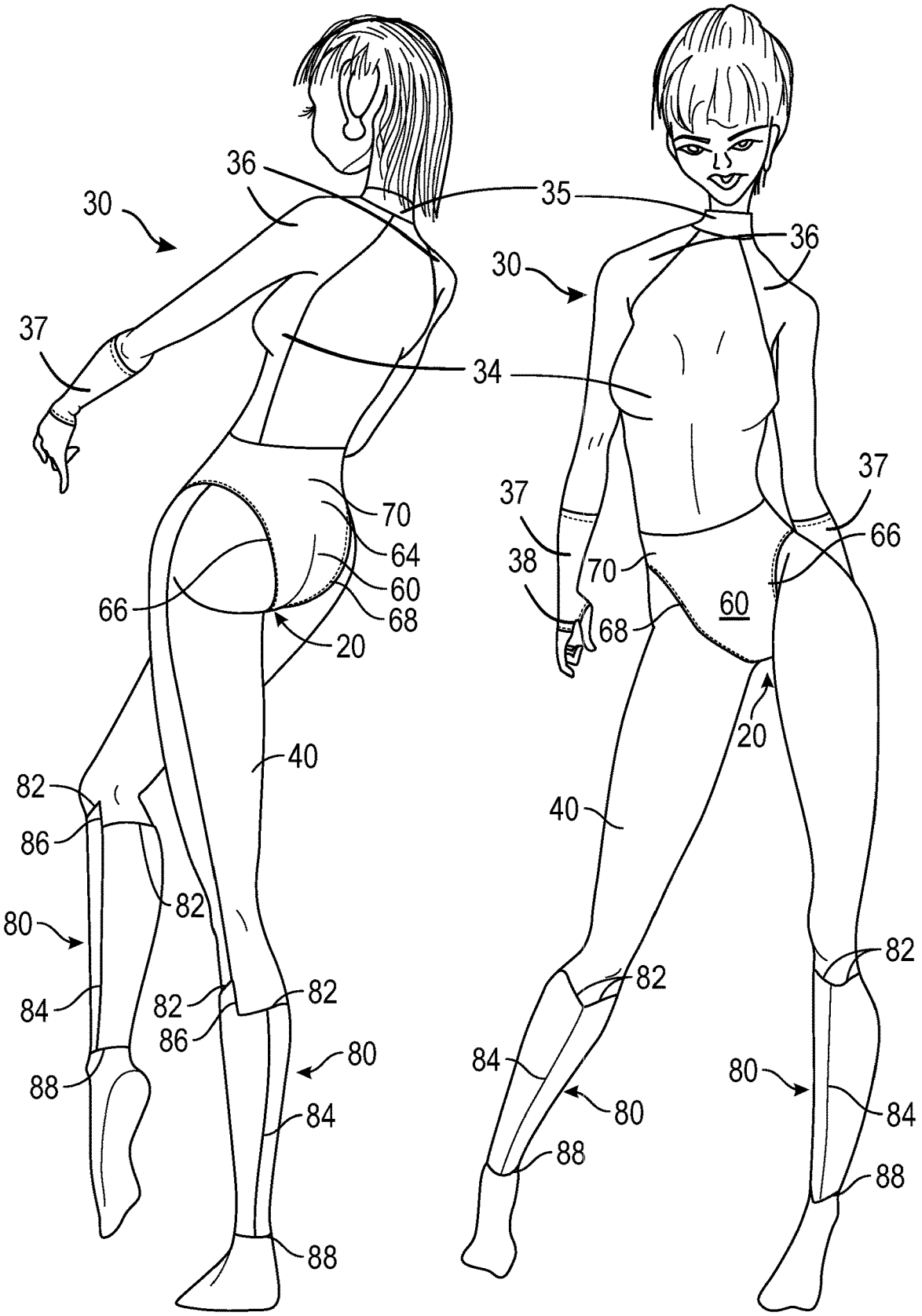

FIG. 3*a* is a full body view of FIG. 1 with a full body example embodiment of the open seat leggings with curtain.

Figure 2:
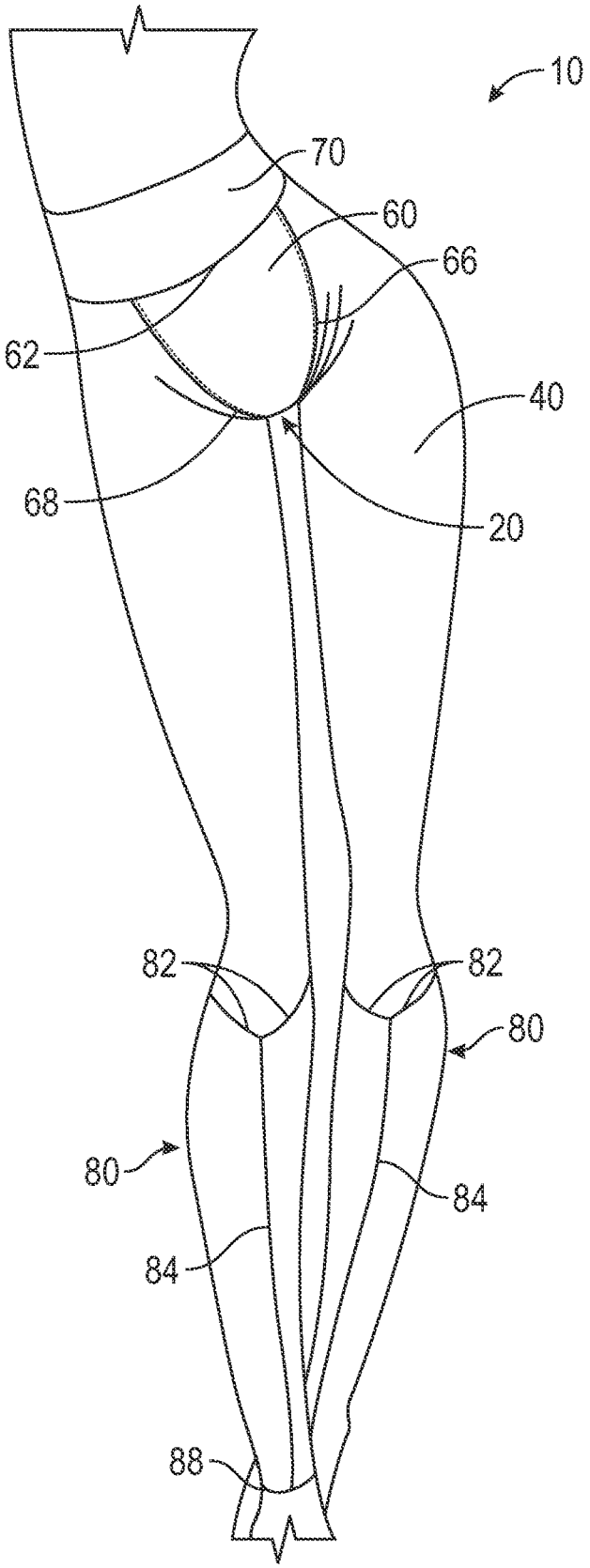
FIG. 2 is a front view of a S-curve pose of another example embodiment.

FIG. 3*b* is a full body view of FIG. 2 with a full body example embodiment of the open seat leggings with curtain.

Figure 4:
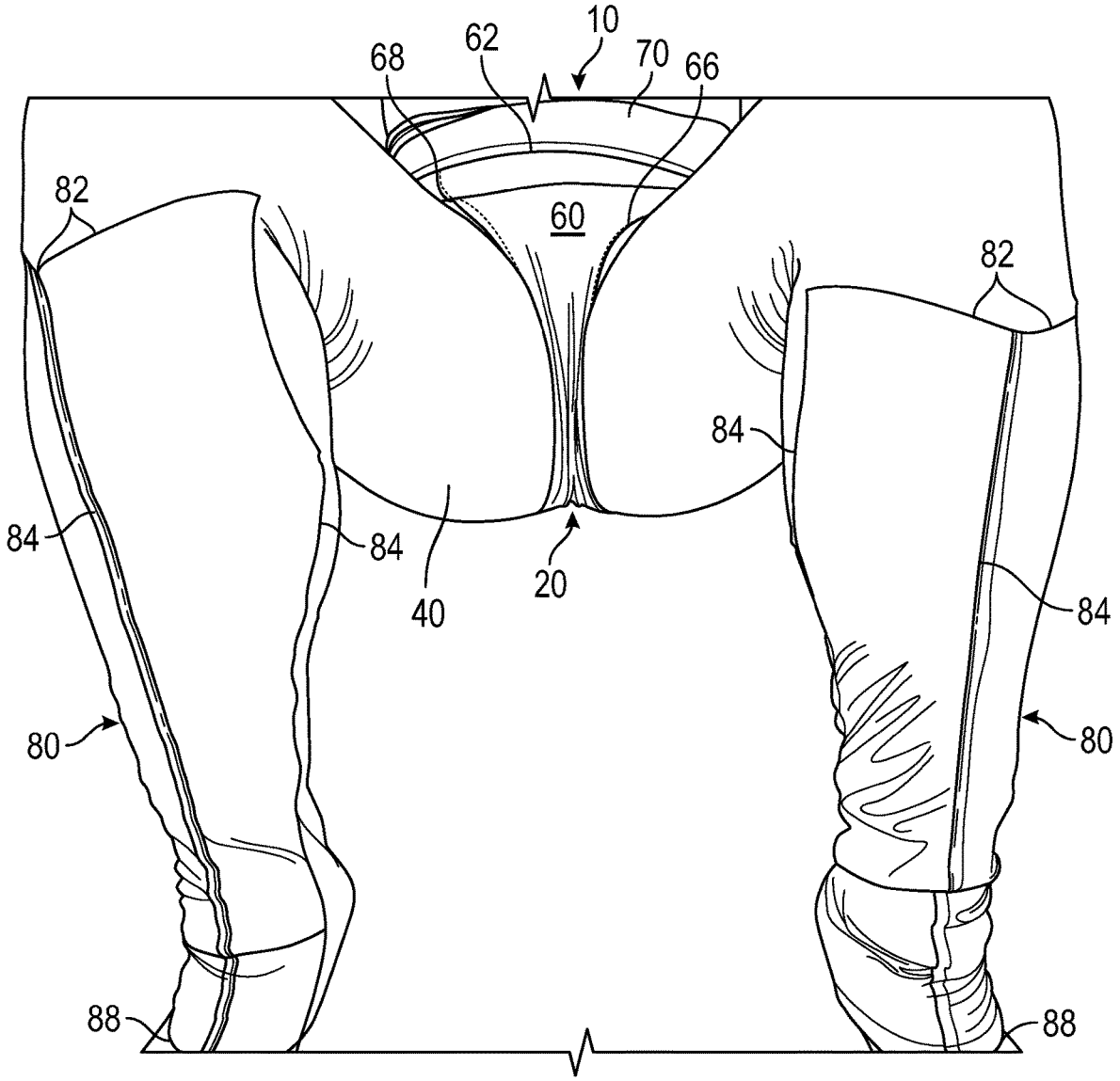

FIG. 4 is an isometric view of semi-reclined seated pose with knees bent of an example embodiment of the open seat leggings with curtain.

Figure 5:
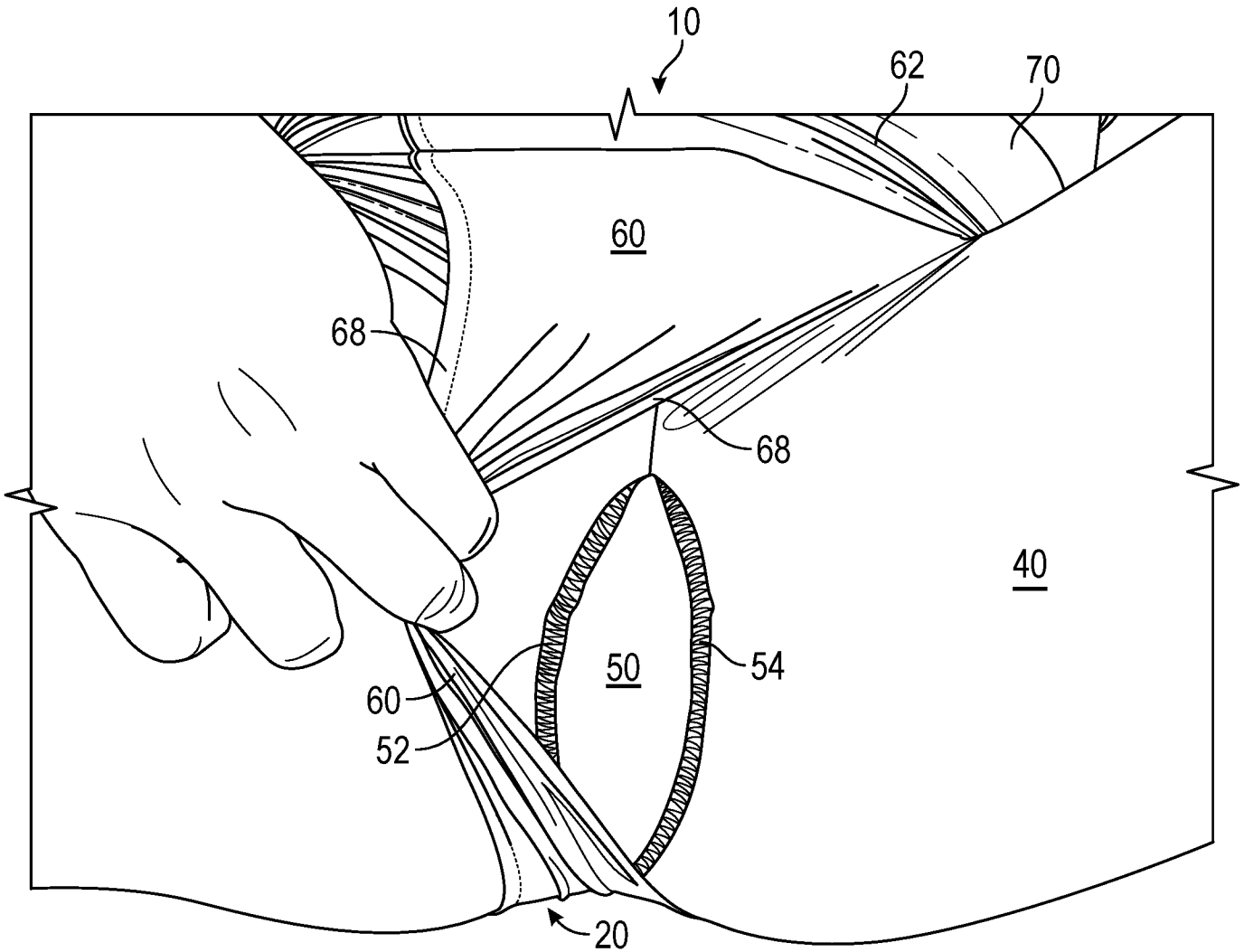

FIG. 5 is an isometric front view of legs splayed while seated pose of the same example embodiment of the open seat leggings with curtain with the seamed opening visible.

Figure 6:
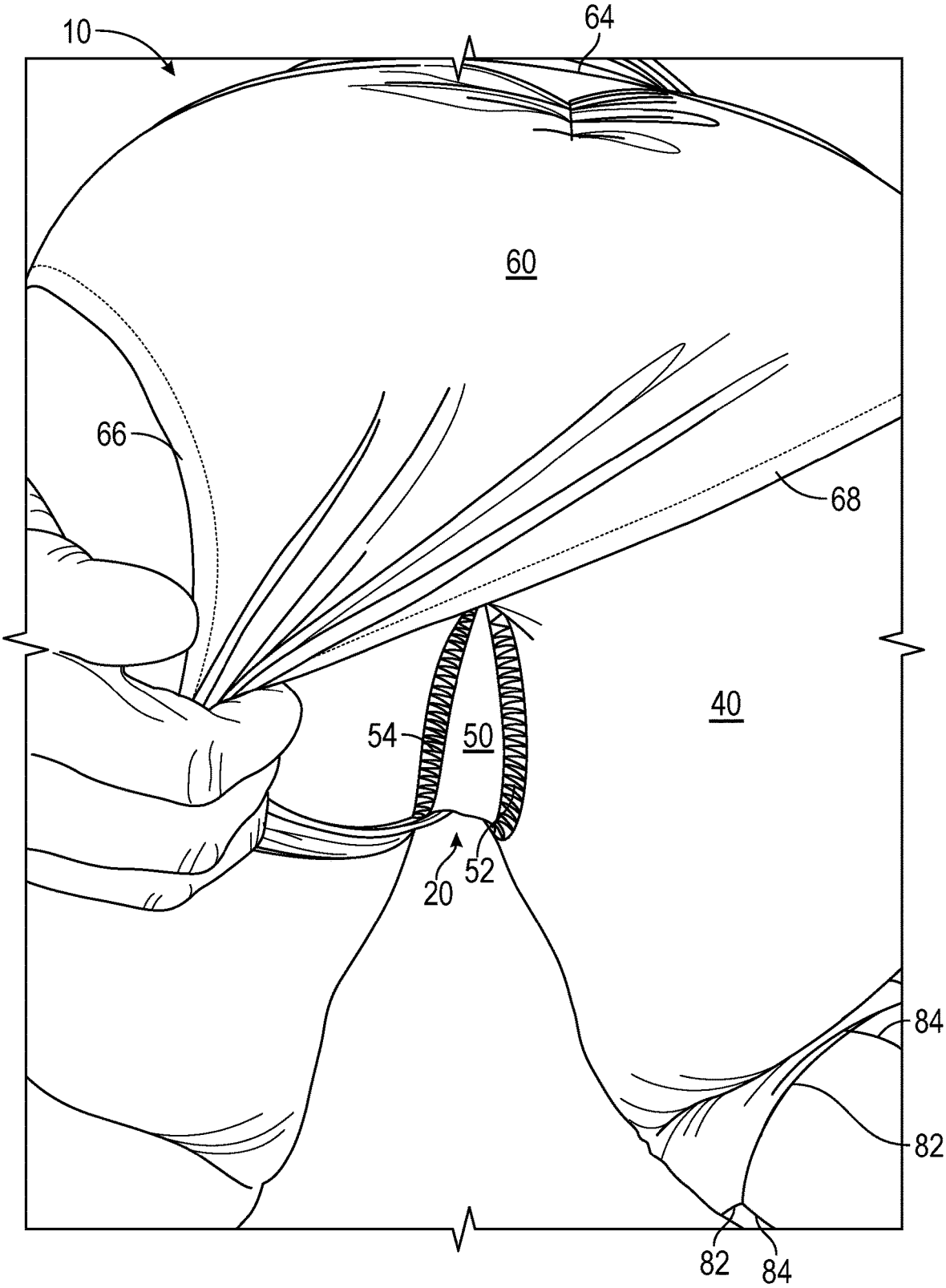

FIG. 6 is an isometric rear view of an all fours pose of the same example embodiment of the open seat leggings with curtain with the seamed opening visible.

DETAILED DESCRIPTION OF THE DRAWINGS

With reference now to the drawings, and in particular FIGS. 1 through 6 thereof, examples of the instant open seat leggings with curtain employing the aforementioned principles and concepts, generally designated by the reference number 10, will be described.

Referring to FIGS. 1 and 2, a front and rear view, respectively, of differing contemplated embodiments of the present open seat leggings with curtain 10 are illustrated as including curtain portion 60 overtop open seat leggings 40. The illustrated embodiment of FIG. 1 depicts an entirely removable curtain portion 60 that sits atop open seat leggings 40 while the illustrated embodiment of FIG. 2 depicts curtain portion 60 having anterior seam 62 (with complementary posterior seam 64 shown in FIG. 6) affixed to a moderately wide style of waistband 70, depicted herein as a portion of open seat leggings 40. Additionally contemplated designs of waistband 70, as a component of either open seat leggings 40 or curtain portion 60, include styles possessing both slimmer and wider widths of waistbands, wherein one such embodiment of the present invention may possess a waistband disposed about a wearer's lower rib cage. Additionally contemplated iterations of waistband 70 of open seat leggings with curtain 10 may also include a pocket, which may be open or fold over or fastenably closeable, for comfortably housing a wearer's personal item(s) during use. Waistband 70 is contemplated in FIG. 2 as a component affixed to both open seat leggings 40 and curtain portion 60 via the aforementioned seams, as affixed solely to curtain portion 60 thereby being removably securable overtop open seat leggings 40, or as affixed solely to open seat leggings 40 as depicted in FIG. 1. A contemplated future design of open seat leggings with curtain 10 may include the addition of magnets stitched into complementary parts of curtain portion 60 and waistband 70 (as a component of open seat leggings 40) such that the former may be securably removable from the latter without fear of incidental sliding down of the article of clothing or wearing out of elastic elements of said article of clothing.

Relating to curtain portion 60 of both FIGS. 1 and 2, first and second free curtain edge 66, 68 are depicted as lying against the body of the wearer while open seat leggings with curtain 10 is being worn, whether at rest or during active use, and run from anterior seam 62 through crotch region 20 to posterior seam 64 (depicted in FIG. 6) in FIG. 2, as opposed to FIG. 1 wherein all edges are free. Although curtain portion 60 is depicted in FIG. 2 as not extending over the hips of the wearer, additionally contemplated designs of open seat leggings with curtain 10 may include iterations wherein anterior seam 62 and posterior seam 64 (depicted in FIG. 6) may meet about both hips of a wearer as well as further designs wherein there will be a singular curtain portion 60 encircling the wearer's waist overtop open seat leggings 40, as in FIG. 1.

Still referring to FIGS. 1 and 2, moving from waistband 70 of open seat leggings with curtain 10 down towards crus portions 80 thereof, the upper leg portions are depicted herein as bare fabric aside from a single out-seam running from about waistband 70 along each of the wearer's outer thighs and legs until it connects with each crus portion 80. Importantly, open seat leggings with curtain 10 does not include, nor does it contemplate the inclusion of, a complementary inseam along a wearer's inner thighs and legs, such as one connecting crotch portion 20 to crus portion 80. Some contemplated embodiments may include this out-seam as connecting directly to vertical knee-step seam 86 (as shown in FIG. 3*b*) or another patellar vertical seam 84. Additionally contemplated design elements envisioned to be present on, or along, the upper leg portion of open seat leggings with curtain 10 includes pockets that are open, fold-over closeable, or fastenably closeable, as well as specifically directed, oriented, and tailored seams (or stitch lines) intended to support a wearer's natural musculature, and expansion thereof, while increasing blood circulation of a wearer throughout use. An example of the inclusion of specific seams, as well as cross and guide stitch lines, is illustrated within crus portions 80 of the present figures.

Relative to the wearer, just below their knee on each leg is at least one patellar horizontal seam 82, stitched into a dart seam in the present embodiment. The inclusion of this seam style offers both room for the knee of a wearer to comfortably bend without resistance while also offering support thereunder, such that in all activities both standing, squatting, on one's knees, and all forms in between, there will be minimal discomfort felt. Not shown in FIG. 2, but visible in FIG. 1, are vertical knee step seams 86, wherein patellar horizontal seams 82 that may operate to support the wearer at a certain height on the front of their crus may conversely hinder the bending, or discomfort the wearer upon bending, beyond a certain height when included on the back of said crus portion 80. As such, vertical knee step seams 86 operate to connect two separated patellar horizontal seams 82 while patellar vertical seam 84 is contemplated and illustrated as connecting patellar horizontal seam 82 with lower crus edge 88. Similar to patellar horizontal seam 82, each patellar vertical seam (or stitch) 84 is contemplated as including dart seams (as well as other styles that may offer additional support to the wearer) to improve blood circulation. These additional seams may include, but should not be limited to, pleats, gathers, tucks, princess seams, straight stitches, cover stitches, zigzag stitches, overlocked stitches, and/or elastic stitches. While not depicted herein, lower crus edge 88 is also contemplated as including embodiments having differing edge widths (similar to waistband 70), a heel or foot enclosing portion, a heel or foot loop portion, or combinations thereof.

Referring next to FIGS. 3*a* and 3*b*, similar views and poses as seen in FIGS. 1 and 2 are illustrated, however, these include the full body of an exemplary wearer of the present invention to depict additionally contemplated embodiments of open seat leggings with curtain 10. While open seat leggings 40 and its crus portions 80 remain unchanged relative to the previous figures, FIGS. 3*a* and 3*b* include contemplated embodiments of the present invention having upper body portions 30. The presently depicted figures illustrate a contemplated version of curtain portion 60 that includes an upper body having a collar portion 35 and two sleeve portions 36 each possessing a forearm portion 37, with seams and stitch lines similar to those of crus portion 80, as well as hand loops 38 at the distal ends thereof. Additional contemplated embodiments include, but are not limited to, individual designs (and combinations of components thereof) possessing an upper body portion 30 of material connected to curtain portion 60 comprising only a tank top portion 34 (or merely a bra portion thereof), a collar portion 35, a sleeveless shirt portion, said shirt portion having at least one sleeve portion 36, at least one hand loop 38 disposed at the distal end of said sleeve portion 36, and/or the inclusion of seams/stitch lines along a forearm portion 37 of said sleeve portion 36 (akin to those of crus portion 80). Although only the full upper body example embodiment is illustrated, the contemplated limitation of said embodiment to individual portions (and combinations) thereof is simply and clearly understood as within the scope of the present invention. Useful for colder climate-based activities, lounging at home, or a plethora of aforementioned activities, a fuller body garment version of open seat leggings with curtain 10 offers additional comfort, warmth, and protection while still allowing the wearer to access their vaginal area with considerable ease without the presence of irritating fasteners and without the need to entirely disrobe regardless of their location.

Referring next to FIGS. 4 through 6, the embodiment of open seat leggings with curtain 10 illustrated in FIG. 1 is depicted here as in use by a wearer performing different poses, such as a sitting back with knees bent front view (FIG. 4), seated front view with legs splayed and curtain portion 60 pulled aside to show widened seamed opening 50 (FIG. 5), and an all-fours rear-view with curtain portion 60 pulled aside to show widened seamed opening 50 (FIG. 6). As can be seen in FIG. 4, waistband 70 connects to curtain portion 60 along anterior seam 62 with first and second free curtain edge 66, 68 running from said connection to, and through, crotch region 20 toward posterior seam 64 (shown in FIG. 6). As is illustrated in FIG. 4, within each crus portion 80, patellar vertical seam 84 extends along the shin of the wearer from about the trough of patellar horizontal seams 82 to lower crus edge 88, depicted here as a layered seam, while patellar vertical seam 84 is depicted here as a simply stitched seam. It is contemplated herein that within embodiments of open seat leggings with curtain 10 all, some, or none of the patellar horizontal seams 82 and patellar vertical seams 84 may be specially stitched or seamed whether in a dart, pleat, tuck, gather, straight, zig zag, cover, or other structurally equivalent style.

Referring next to FIGS. 5 and 6, the wearer is illustrated as pulling aside curtain portion 60 via first and second free curtain edge 66, 68 within crotch region 20 to reveal a widened seamed opening 50 bound by first and second opening seam 52, 54. Unlike aforementioned disclosed references, first and second opening seam 52, 54 are not overlapped, possess no flaps or inseams connected thereto, and include no fastening elements or structures relating thereto. Upon squatting, sitting, or similar movements, and upon the pulling aside of curtain portion 60, seamed opening 50 of crotch region 20 retains an open position such that a wearer may urinate, replace a sanitary item, or otherwise access their vaginal area without the need for undressing (either partially or completely) thereby offering more warmth, comfort, and accessibility for women in public, remote, outdoor, or other locations. Although both FIGS. 5 and 6 depict curtain portion 60 as being pulled aside by the wearer, it is contemplated and understood that this invention merely requires such intervention prior to use (and return of this element into place after use), wherein during use curtain portion 60 may occupy the space (or channel) between the genital area and the thigh, remaining in place there due to the tension of material caused by the wearer's sitting or squatting position. Additionally contemplated embodiments also include a smaller (or tighter) curtain portion 60, as compared to the remaining open seat leggings 40 of open seat leggings with curtain 10, thereby making the applicability of tension more pronounced and guaranteeing no accidental sliding, tangling, or moving of curtain portion 60 back over seamed opening 50 during use thereof.

As it relates to material, open seat leggings with curtain 10 is contemplated as including either in its entirety, as constituent portions, or in a variety of potential combinations a medley of elastomeric fibers and fabrics, such as but not limited to Lycra, Spandex, elastance, polyester, as well as other elasticized polyurethanes, in addition to blends thereof such that each and every portion of open seat leggings with curtain 10 will tautly conform to the body of the wearer. However, as previously mentioned, it is additionally contemplated that certain portions of open seat leggings with curtain 10, such as curtain portion 60 and crus portion 80, may more tightly fit a wearer's body in order to offer further amounts of tension, musculature support, or blood circulation. Thus, it can be seen that the orientation of fabric and material portions will not improperly or spontaneously move, slide, tangle, or otherwise part without a wearer's knowledge and intentional action during wearing, and overall use, of the present invention.

Therefore, these depicted contemplated embodiments of open seat leggings with curtain 10 combines the ease of access and use of a wearer's vaginal area with fastenerless comfort and security, which sets it apart from the vast majority of products and disclosed references within the field. As previously mentioned, future embodiments of open seat leggings with curtain 10 are envisioned as potentially including magnetic fasteners as they are least likely to catch, create holes, fall off, break, etc. One such embodiment may contemplate the inclusion of magnetic fasteners stitched directly into specific seams (or edges) of open seat leggings 40 and curtain portion 60 such that the upper edge of each, for instance about the waist of a user, are securably removable from one another unlike previously mentioned contemplated embodiments wherein said upper edges are permanently affixed to one another (via anterior and posterior seams 62, 64). Further embodiments may include upper body portion 30 having similar fasteners within its lower edge to removably secure it to those of curtain portion 60 and/or open seat leggings 40. As previously stated, upper body portion 30 is contemplated as including but not limited to the individual components, or combinations thereof, of a bra portion, tank top portion 34, collar portion 35, at least one sleeve portion 36, a forearm portion 37 (having structural design and benefits akin to crus portion 80), and a hand loop 38 at the distal end of said sleeve portion 36.

The invention claimed is:

1. An open seat leggings with curtain apparatus comprising:
- a fastenerless pair of leggings having an open seat, said pair of leggings comprising:
  - a waistband;
  - a fastenerless seamed opening disposed in a crotch region;
- a curtain portion disposed to overlie the seamed opening, said curtain portion comprising:
  - a garment capable of being worn over the open seat leggings and covering the wearer's crotch region;
  - an upper edge;
  - an anterior seam attached proximal to an anterior section of the waistband; and
  - a posterior seam attached proximal to a posterior section of the waistband;
- said open seat leggings with curtain apparatus possessing no in-seam along the inner legs of a wearer;
- wherein drawing the curtain portion to one side then squatting, sitting, or genuflecting while wearing the open seat leggings widens the fastenerless seamed opening and maintains the drawn curtain portion aside via tension whereby a female wearer may urinate through the seamed opening without soiling the apparatus.

2. The open seat leggings with curtain apparatus of claim 1 wherein the apparatus is at least partially comprised of elastomeric fibers, elasticized polyurethanes, or blends thereof, whereby each element is configured to tautly conform to the wearer's body.

3. The open seat leggings with curtain apparatus of claim 1 further comprising:
- at least one crus portion comprising:
  - at least one patellar horizontal seam configured to overlie the wearer's patella, below about the intercondylar eminence, and configured to encircle the wearer's leg; and
  - at least one patellar vertical seam connecting the at least one patellar horizontal seam to a lower crus edge of the crus portion;
- wherein the leggings are configured to conform to and accommodate flexion of the wearer's knees.

4. The open seat leggings with curtain apparatus of claim 3 wherein the at least one patellar horizontal seam is configured to be disposed within at least forty-five degrees of the wearer's transverse plane and wherein the at least one patellar vertical seam is disposed within at least forty-five degrees of the wearer's sagittal plane.

5. The open seat leggings with curtain apparatus of claim 4 wherein the at least one patellar vertical seam and the at least one patellar horizontal seam are each sewn as a dart, pleat, gathers, tuck, princess seam, straight stitch, cover stitch, zigzag stitch, overlocked stitch, or elastic stitch.

6. The open seat leggings with curtain apparatus of claim 5 wherein the at least one patellar vertical seam includes two patellar vertical seams, each of which said two patellar vertical seams connect the at least one patellar horizontal seam to the lower crus edge.

7. The open seat leggings with curtain apparatus of claim 6 further comprising at least two vertical knee-step seams.

8. The open seat leggings with curtain apparatus of claim 7 wherein the at least one patellar horizontal seam includes two patellar horizontal seams, wherein each of the two patellar horizontal seams are interconnected by the at least two vertical knee-step seams.

9. The open seat leggings with curtain apparatus of claim 2 wherein the curtain portion is configured to be smaller in dimensionality than the pair of leggings to tautly conform to the wearer's body and keep the curtain portion in place when either standing, squatting, or sitting.

10. The open seat leggings with curtain apparatus of claim 1 wherein the anterior seam and the posterior seam of the curtain portion are configured to connect with one another to fully encircle the waist and each leg of the wearer.

11. The open seat leggings with curtain apparatus of claim 5 wherein the inclusion of the at least one patellar vertical seam and/or the at least one patellar horizontal seam is configured to create pressure on the wearer that promotes blood flow and thereby improves circulation.

12. The open seat leggings with curtain apparatus of claim 1 further comprising an upper body portion comprising:

a connected bra or tanktop portion connected to the curtain portion.

13. The open seat leggings with curtain apparatus of claim 12 further comprising at least one sleeve portion having a proximal end connected to the upper body portion and a distal end culminating at a wrist edge configured to be disposed about the wearer's wrist.

14. The open seat leggings with curtain apparatus of claim 1 further comprising at least one pocket for holding the wearer's personal item(s).

15. The open seat leggings with curtain apparatus of claim 3 further comprising at least one foot loop connected to the lower crus edge.

16. The open seat leggings with curtain apparatus of claim 13 further comprising at least one hand loop portion connected to the at least one forearm portion with said at least one horizontal and at least one vertical seams included thereon.

17. The open seat leggings with curtain apparatus of claim 16 further comprising:

at least one forearm portion comprising:

at least one horizontal seam configured to be positioned below the wearer's elbow, below the epicondyle, and encircling the wearer's arm; and at least one vertical seam connecting the at least one horizontal seam to the at least one hand loop portion;

wherein the leggings are configured to conform to and accommodate flexion of the wearer's knees.

* * * * *